US008668467B2

(12) United States Patent
Douglas et al.

(10) Patent No.: US 8,668,467 B2
(45) Date of Patent: Mar. 11, 2014

(54) INTEGRATED FLUID HANDLING APPARATUS

(75) Inventors: Robert Bruce Douglas, LaGrange, KY (US); Dale Vanderlaan, Kalamazoo, MI (US); Bruce D. Larkin, Plainwell, MI (US)

(73) Assignee: Parker Hannifin Corporation, Cleveland, OH (US)

( * ) Notice: Subject to any disclaimer, the term of this patent is extended or adjusted under 35 U.S.C. 154(b) by 588 days.

(21) Appl. No.: 12/818,523

(22) Filed: Jun. 18, 2010

(65) Prior Publication Data

US 2011/0014070 A1 Jan. 20, 2011

Related U.S. Application Data

(60) Provisional application No. 61/226,029, filed on Jul. 16, 2009.

(51) Int. Cl.

| | |
|---|---|
| ***F04B 9/00*** | (2006.01) |
| ***F04B 35/00*** | (2006.01) |
| ***F04B 39/02*** | (2006.01) |
| ***F16C 31/02*** | (2006.01) |

(52) U.S. Cl.

USPC ..... 417/223; 417/313; 417/319; 417/371; 60/435; 60/456

(58) Field of Classification Search

USPC ..... 417/411, 231, 223, 319, 313, 374, 364, 417/316, 366, 371; 60/418, 456, 435

See application file for complete search history.

(56) References Cited

U.S. PATENT DOCUMENTS 2,736,202 A * 2/1956 Wagner ..... 74/15.86
2,972,308 A 2/1961 Haggerty
3,672,793 A 6/1972 Yowell
3,790,309 A 2/1974 Volz (Continued)

FOREIGN PATENT DOCUMENTS

EP 0541337 B1 1/1996
EP 0601751 B1 5/1997

OTHER PUBLICATIONS

Parker Hannifin Corporation—Oildyne Division, Compact Fluid Power Systems, Feb. 2006, Catalog HY22-1121/US, Minneapolis, MN, US.

KYB America LLC, Mini-Motion Package, Addison, IL, US.

(Continued)

*Primary Examiner* — Peter J Bertheaud

(74) *Attorney, Agent, or Firm* — Renner, Otto, Boisselle & Sklar, LLP

(57) ABSTRACT

An integrated fluid handling apparatus 10 includes a power take off device 108 having a rotating power take off mechanism 122, a hydraulic pump 104 having a rotating fluid pump mechanism 146, a flow torque tube 106, and an electric motor/generator 102 having a rotating electric power conversion mechanism 173. A rotational power transfer system includes connector devices 128, 138, 166 and 172 that are drivingly connected to and that drivingly connect the mechanisms 122, 146 and 173 in one mode of operation. The electric motor/generator 102 includes heat exchange fluid flow passages that establish a fluid flow path to the inlet of the pump. The mechanisms 122, 146 and 173, and the connector devices 128, 138, 166 and 172 are assembled and used as a whole within a housing, without externally exposed mechanical drive connections and without externally exposed fluid connections, between such mechanisms and devices.

35 Claims, 6 Drawing Sheets

(56) References Cited

U.S. PATENT DOCUMENTS

| | | | | | |
|---|---|---|---|---|---|
| 4,529,362 | A | | 7/1985 | Ichiryu et al. | |
| 4,850,812 | A | | 7/1989 | Voight | |
| 5,144,801 | A | | 9/1992 | Scanderbeg et al. | |
| 5,181,837 | A | * | 1/1993 | Niemiec | 417/350 |
| 5,220,225 | A | | 6/1993 | Moon, Jr. | |
| 5,242,278 | A | * | 9/1993 | Vanderslice et al. | 417/364 |
| 5,261,796 | A | | 11/1993 | Niemiec et al. | |
| 5,320,501 | A | | 6/1994 | Langosch et al. | |
| 5,346,370 | A | * | 9/1994 | Krohn | 417/223 |
| 5,354,182 | A | | 10/1994 | Niemiec et al. | |
| 5,591,013 | A | | 1/1997 | Kawafune et al. | |
| 6,402,576 | B1 | | 6/2002 | Klug | |
| 6,499,964 | B2 | | 12/2002 | Staton et al. | |
| 6,524,084 | B2 | | 2/2003 | Neumair | |
| 7,182,583 | B2 | | 2/2007 | Gandrud et al. | |
| 7,275,917 | B1 | * | 10/2007 | Hicks | 417/53 |
| 2007/0053780 | A1 | | 3/2007 | Ruffner et al. | |
| 2008/0141800 | A1 | * | 6/2008 | Seitz et al. | 74/15.82 |
| 2009/0022608 | A1 | * | 1/2009 | Rogner | 417/423.1 |
| 2010/0068071 | A1 | * | 3/2010 | Bowden | 417/16 |

OTHER PUBLICATIONS

Eaton Hydraulic, Incorporated 2000, Vickers, Power Units/Systems, Integrated Motor Pump MP15, MP22, MP45, MP75 & MP92, 15kW, 20 hp to 92 kW, 125 hp,5035.00/EN/1097/A, pp. 1-6.

* cited by examiner

INTEGRATED FLUID HANDLING APPARATUS

CROSS REFERENCE TO RELATED APPLICATIONS

The present application claims the benefit of the filing date of U.S. Provisional Patent Application Ser. No. 61/226,029, filed Jul. 16, 2009, the disclosure of which is incorporated herein by reference in its entirety.

TECHNICAL FIELD

This invention relates to an integrated fluid handling apparatus. More particularly, this invention relates to an integrated fluid handling apparatus that includes a fluid pump mechanism and an electric machine.

BACKGROUND OF THE INVENTION

Fluid pumps are used on a wide variety of stationary and mobile equipment to impart energy to fluids to transfer such fluids or to enable such fluids to cause or control movement or work. The fluid pump may be any of a wide variety of known pump types and may pump any of a wide variety of known fluids. Also, any of a wide variety of known prime movers, and a combination of different types of prime movers operating under different modes of operation, may be used as a power source for the fluid pump.

In one of many such applications, a fluid pump is used on a mobile vehicle to power various accessory devices on the vehicle. The fluid pump may be a hydraulic pump, and the vehicle may be an over the road vehicle that includes a man lift bucket that is raised and lowered and controlled by hydraulic fluid that is pressurized by the pump to transfer energy from a prime mover power source to the hydraulic fluid. The pressurized hydraulic fluid is controlled by valves and powers hydraulic cylinders that extend and retract to move and control the bucket. Vehicles of this type are used for moving workers to high or low or otherwise difficult to reach locations for doing work tasks, such as inspecting or maintaining bridges, trimming trees, repairing electrical power lines, constructing or repairing buildings, and numerous other tasks.

The fluid pumps in such applications may be driven by a prime mover fossil fuel engine of the vehicle (such as a gasoline or diesel engine). This may require that the fossil fuel engine of the vehicle is run during operation of the lift bucket when the vehicle is stationary. This may cause substantial fuel consumption during such operation. This may also cause noise and combustion fumes in locations at which such noise and fumes are objectionable. Other known systems couple an electric machine, such as an electric motor, and a hydraulic pump, with the hydraulic pump being driven by the electric motor. Fluid pumps in other applications may be driven by a fossil fuel engine of the vehicle under some conditions and by other power sources, such as an electric motor, during other conditions.

SUMMARY OF THE INVENTION

The present invention provides an integrated fluid handling apparatus that may be used in a wide variety of applications. As used herein, the terms "integrated," "integral" and/or "unitary," in reference to a fluid apparatus mean two or more functionally cooperating devices that are assembled and used as a whole within a multiple component or single component housing, without externally exposed mechanical drive connections and without externally exposed fluid connections, between such devices.

The apparatus may include a fluid pump mechanism and a power take off device mechanism and an electric motor generator mechanism, all disposed in a unitary housing and all of which may be rotating mechanisms. The rotating fluid pump mechanism may include a lower pressure fluid inlet and a higher pressure fluid outlet. The rotating power take off mechanism may be driven by a power source such as a fossil fuel engine. The rotating electric motor generator mechanism may be arranged to provide power to charge a battery under a first mode of operation and to use power from the battery under a second mode of operation. A rotational power transfer system may include drive connector devices that drivingly connect the rotating fluid pump mechanism and the rotating power take off device mechanism and the rotating electric motor generator mechanism under the first mode of operation, to supply fluid under pressure to the higher pressure fluid outlet and to charge the battery. The rotational power transfer system may also drivingly isolate the rotating power take off device mechanism from the rotating fluid pump mechanism and from the rotating electric motor generator mechanism in the second mode of operation. The electric motor generator may include heat exchange fluid flow passages that are connected to and establish a fluid flow path to the lower pressure fluid inlet, so that inlet flow to the fluid pump removes heat from the electric motor generator.

The rotating fluid pump mechanism may have a longitudinal axis and opposite sides, and the rotating electric motor generator mechanism may be disposed on one of sides while the rotating power take off device mechanism may be disposed on the other side. The drive connector devices may be rotating power shafts, and the rotating mechanisms and rotating power shafts may all be axially aligned. A clutch may be provided in the power transfer system to alternately connect the power transfer system between the first mode of operation in which the clutch is engaged and in the second mode of operation in which the clutch is disengaged.

The rotating fluid pump mechanism and the rotating electric motor generator mechanism may be separated from one another by a torque tube, with the flow torque tube being arranged in the same unitary housing with the rotating mechanisms. The flow torque tube may include another fluid flow passage that connects the first mentioned fluid flow passages with the lower pressure fluid inlet and the rotating connector device that drivingly connects the rotating fluid pump mechanism with the rotating electric motor generator mechanism. The last mentioned connector device may be a shaft that is rotatably disposed in the fluid inlet.

The apparatus may also include an electrical power inverter with fluid flow heat exchange passages. According to one preferred embodiment, the inverter passages may be connected in a fluid flow path that may include an orifice or other flow restriction device and the higher pressure fluid outlet.

The invention also provides various ones of the features and structures described in the claims set out below, alone and in combination, which claims are incorporated by reference in this summary of the invention.

BRIEF DESCRIPTION OF THE DRAWINGS

Embodiments of this invention will now be described in further detail with reference to the accompanying drawings, in which.

DETAILED DESCRIPTION OF THE INVENTION

The principles, embodiments and operation of the present invention are shown in the accompanying drawings and described in detail herein. These drawings and this description are not to be construed as being limited to the particular illustrative forms of the invention disclosed. It will thus become apparent to those skilled in the art that various modifications of the embodiments herein can be made without departing from the spirit or scope of the invention.

Figure 1:
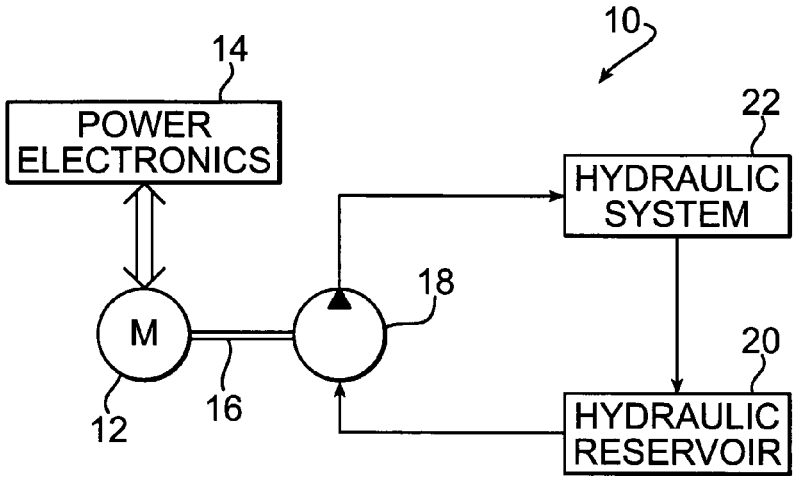
FIG. 1 (PRIOR ART)
FIG. 1 is a schematic circuit diagram of a known prior art fluid system.

Many known systems couple an electric machine, such as an electric motor, and a hydraulic pump. Operation of the electric motor drives the hydraulic pump to provide fluid to a hydraulic system. FIG. 1 illustrates a known system 10 in which an electric motor 12 receives electric power from a power source that includes power electronics 14. In response to the electric power, the electric motor 12 rotates an output shaft 16. Rotation of the output shaft 16, in turn, results in rotation of the hydraulic pump 18. The output shaft 16 may be an input shaft to the hydraulic pump 18 or, alternatively, the output shaft 16 may be coupled to an input shaft of the hydraulic pump 18 in any known manner. Hydraulic pump 18 may be any known type of hydraulic pump that is responsive to rotation of its input shaft for pumping hydraulic fluid. Rotation of the hydraulic pump 18 draws hydraulic fluid from the hydraulic reservoir 20 and provides the hydraulic fluid to a hydraulic system 22. After the hydraulic fluid is used in the hydraulic system 22, the hydraulic fluid returns to the hydraulic reservoir 20.

Figure 2:
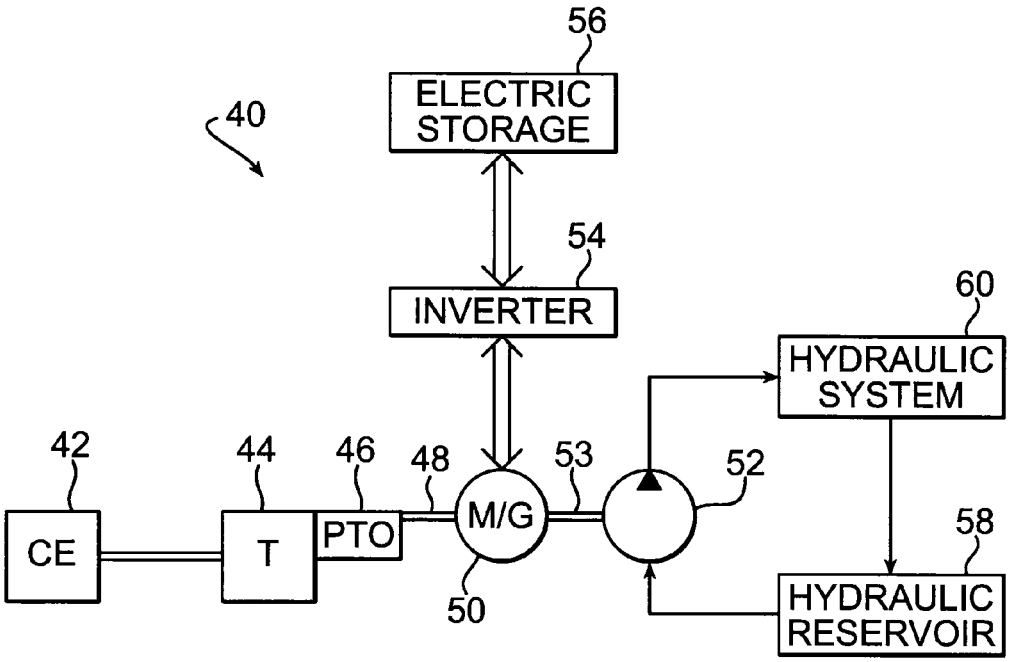
FIG. 2 (PRIOR ART)
FIG. 2 is a schematic circuit diagram of another known prior art fluid system.

FIG. 2 illustrates an embodiment of another known system 40. In the system 40, a combustion engine 42 drives a transmission 44. A power take-off device 46 is coupled to the transmission 44 in a known manner. The power take-off device 46 includes an engageable clutch for enabling the power take-off device to use power transmitted by the transmission 44 for rotating an output shaft 48 of the power take-off device. The output shaft 48 of the power take-off device 46 is connected to an electric machine 50. Rotation of the output shaft 48 results in rotation of a rotor of the electric machine 50. The electric machine 50 is an electric motor/generator. The electric motor/generator 50 is mechanically coupled to hydraulic pump 52 by drive shaft 53. The electric motor/generator 50 is also electrically coupled to an inverter 54, with the inverter 54 electrically coupled to an electric storage device 56.

When the clutch of the power take-off device 46 is engaged, rotation of the output shaft 48 results in the electric motor/generator 50 acting as an electric generator. Electrical power generated by the electric motor/generator 50 is provided to the inverter 54, which conditions the electric power for storage and provides the electric power to the electric storage device 56 for storage. Also, when the clutch of the power take-off device 46 is engaged, the output shaft 48 and the drive shaft 53 rotate the hydraulic pump 52. Upon rotation of the hydraulic pump 52, hydraulic fluid is removed from a hydraulic reservoir 58 and is provided to a hydraulic system 60. After use in the hydraulic system 60, the hydraulic fluid returns to the hydraulic reservoir 58.

When the clutch of the power take-off device 46 is disengaged, the electric motor/generator 50 may act as an electric motor and draw electric power from the electric storage device 56 through the inverter 54. When acting as an electric motor, the electric motor/generator 50 rotates the hydraulic pump 52 for drawing hydraulic fluid from the hydraulic fluid reservoir 58 and providing the hydraulic fluid to the hydraulic system 60.

When used in mobile equipment, the coupled electric machine and hydraulic pump is often difficult to package in the tight constraints of the mobile equipment. When using a power takeoff device to utilize the power provided to a transmission, locating the electric machine and hydraulic pump about the transmission housing is often difficult. Also, as heat is a major issue when dealing with mobile equipment, maintaining the ambient temperature in and around the electric machine is of critical concern.

Figure 3:
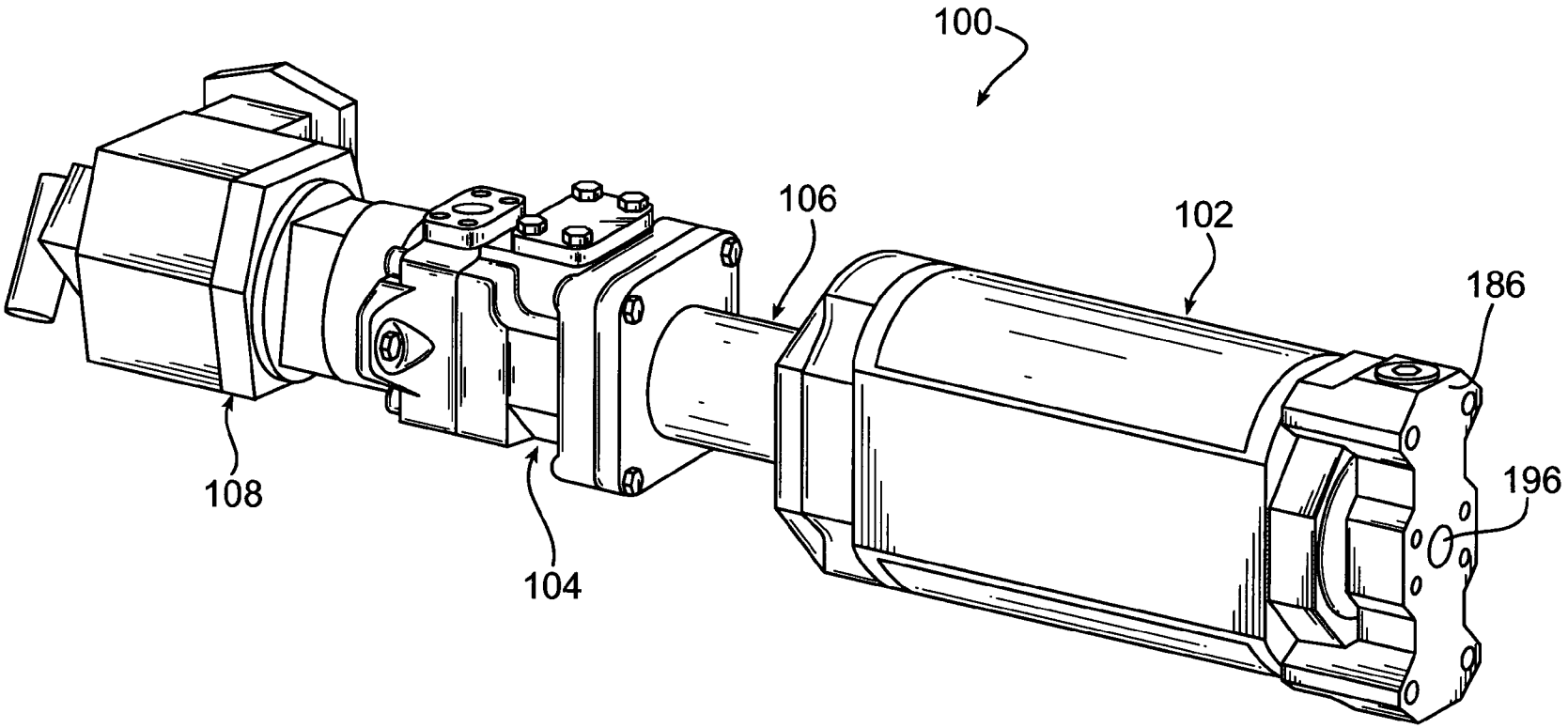
FIG. 3 is a perspective view of one preferred embodiment of the present invention.

FIG. 3 is a perspective view of an integrated fluid handling apparatus 100 of the present invention. The apparatus 100 may be used in any stationary or mobile application, such as any application in which mechanical power is to be transferred from a prime mover power source to a fluid. For example, in the preferred embodiment shown in FIG. 3, the integrated fluid handling apparatus 100 is used with hydraulic fluid and is mounted on a fossil fuel engine powered over the road vehicle that includes hydraulically operated equipment. In this preferred embodiment, the hydraulically operated equipment includes a man lift bucket that is raised and lowered and controlled by hydraulic fluid that is provided by the apparatus 100 to extend and retract and otherwise move and control the bucket.

The apparatus 100 of FIG. 3 includes an electric machine, which in this embodiment is electric motor/generator 102, and a hydraulic pump 104. The apparatus 100 illustrated in FIG. 3 further includes a flow torque tube 106 that couples the electric motor/generator 102 and the hydraulic motor 104. Also, the apparatus 100 includes a power take off device 108. These and other structural features of the fluid handling apparatus 100 are further discussed below with reference to FIGS. 4 and 5.

Figure 4:
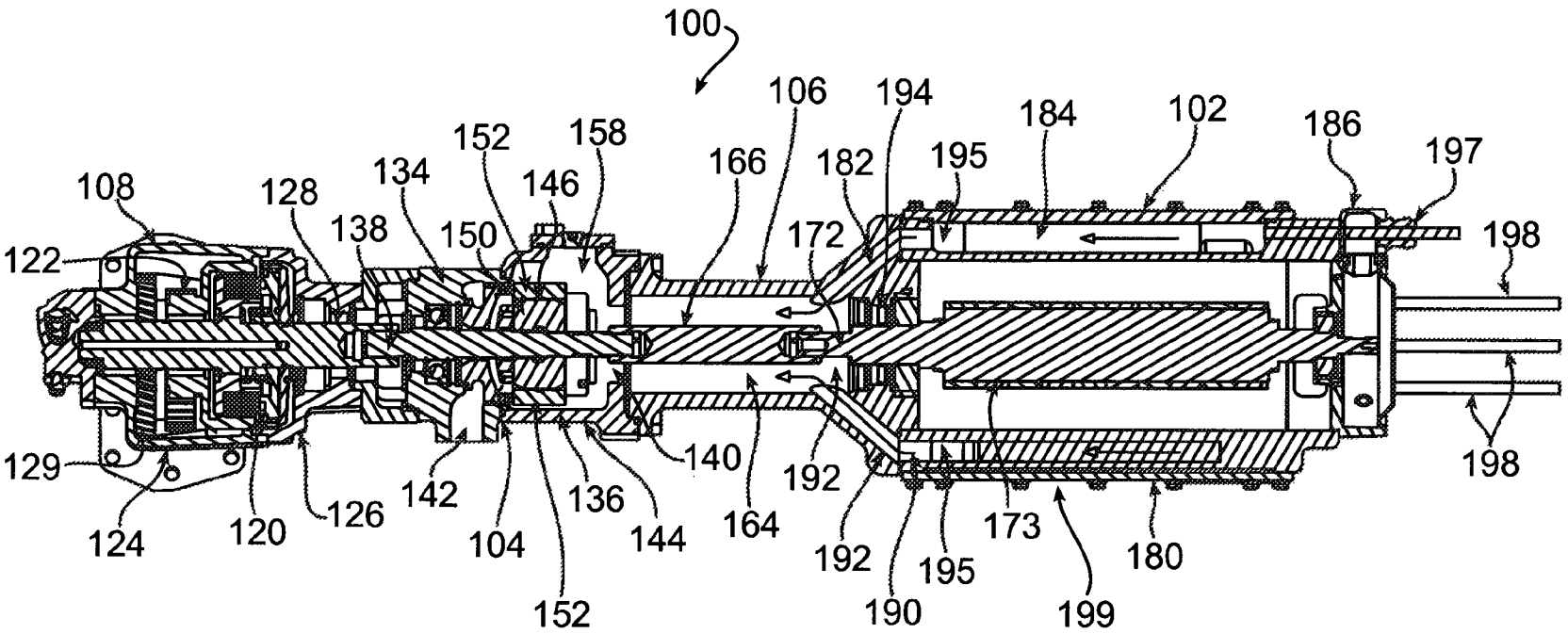
FIG. 4 is a cross sectional side elevation view of the embodiment of the present invention illustrated in FIG. 3.

With reference to FIG. 4, the power take off device 108 is generally of a known design and includes a clutch 120 that may be engaged or disengaged and a plurality of gears 122. The clutch 120 and gears 122 of the power take-off device 108 are located in a power take off device housing 124. A generally tubular nose cup 126 of the housing 124 defines an opening through which an output shaft 128 of the power take-off device 108 extends. A portion of the nose cup 126 is adapted to engage an end cap 134 of the hydraulic pump 104.

Still referring to FIG. 4, the power take off device 108 further includes a rotating power take off device input gear 129 that extends in a well known manner outwardly of the housing 124 and which may be connected to and rotationally driven by a power source such as a transmission of a fossil fuel engine driven over the highway service truck (not shown) in a well known manner. The gears 122 provide a rotating power take off device mechanism and may be conventional planetary gears. The clutch 120 is normally disengaged and is electrically operated.

The hydraulic pump 104 may be a hydraulic pump/motor which may be operated in one mode as a hydraulic pump and in another mode as a hydraulic motor. In FIG. 4, the hydraulic pump is illustrated as a vane pump that may also be operated as a motor. Those skilled in the art should recognize that the hydraulic pump 104 may be an inline axial piston pump, a gear pump, or any other type of pump. Although the hydraulic pump 104 may be operated as either a pump or a motor as is well known, in the preferred embodiment the pump 104 is operated as a pump in the described modes of operation of the integrated fluid handling apparatus 100.

The hydraulic pump 104 includes an end cap 134, which forms a portion of a housing 136 of the hydraulic pump 104. The output shaft 128 of the power take off device 108 extends into the end cap 134 and is drivingly connected to a drive shaft 138 of the hydraulic pump 104. The housing 136 of the hydraulic pump 104 also defines ports 140 and 142 for hydraulic fluid. The port 140 is a lower pressure fluid inlet port which supplies fluid to the pump 104 and the port 142 is a higher pressure fluid output port, when the pump 104 is driven and operated as a pump. Additionally, other fluid inlet and/or outlet ports may be provided in the housing 136 as desired for alternate and/or additional fluid flow ports in the apparatus 100. The end cap 134 of the housing 136 is attached to a main housing portion 144 of the housing 136 of the hydraulic pump 104. The mechanical components or rotating fluid pump mechanism 146 of the hydraulic pump 104 are located within the main housing portion 144. FIG. 4 illustrates the rotating fluid pump mechanism 146 as including a rotor 150 and a plurality of moveable vanes 152, as are well known. The main housing portion 144 also defines a chamber 158 for hydraulic fluid. FIG. 4 illustrates no end cap located on a side of the main housing portion 144 opposite end cap 134. Instead, the annular inlet port 140 defined by the main housing portion 144 is located circumferentially about the drive shaft 138 of the hydraulic pump 104 and leads into the housing 136 of the hydraulic pump 104 to provide a lower pressure fluid inlet 140 for the pump 104. The annular inlet port 140 is in fluid communication with the chamber 158 within the main housing portion 144 of the hydraulic pump 104 and is also in fluid communication with an annular passage 164 located within the flow torque tube 106.

With continuing reference to FIG. 4, the flow torque tube 106 is a tubular structure having a housing 159 with a first end adapted to be attached to the main housing portion 144 of the hydraulic pump 104 and a second end adapted to be connected to the electric motor/generator 102. A shaft 166 is located in and extends axially through the center of the housing 159 of the flow torque tube 106. The shaft 166 includes a first splined end for drivingly connecting the shaft 166 to the drive shaft 138 of the hydraulic pump 104. A second splined end of the shaft 166 is drivingly connected to a drive shaft 172 of the electric motor/generator 102. The annular passage 164 that extends through the flow torque tube 106 is located radially outside of the shaft 166. In this manner, the flow torque tube 106 provides an integral fluid spacer adjustment and drive connector spacer adjustment between the electric motor/generator 102 and the hydraulic pump 104 to permit location of the apparatus 100 in a manner that does not interfere with other vehicle components.

The electric motor/generator 102 includes a rotor and a stator as is known in the art. The rotor provides a rotating electrical power conversion mechanism 173, and the mechanism 173 is attachable to the drive shaft 172 and is fixed for rotation with the drive shaft 172. When the drive shaft 172 is rotated by the interconnected shafts or connector devices 166 and 138, the electric motor/generator operates as an electrical generator. The driven rotation of the rotating electrical power conversion mechanism 173 relative to the stator results in the generation of electric power, which is provided to electrical components such as an inverter and electric storage device, as is previously discussed with reference to FIG. 2. In another mode of operation, electric power may be provided to the stator for powering rotation of the rotating electrical power conversion mechanism 173 and, thus, rotation of the drive shaft 172, to cause the electric motor/generator 102 to operate as an electric motor.

Still referring to FIG. 4, the electric motor/generator 102 includes a housing 180. The housing includes a first end cap 182, a central housing portion 184 and a second end cap 186 (the second end cap is best shown in FIG. 3). The first end cap 132 includes an annular cavity 190 located near an outer periphery of the end cap. A plurality of radially extending passages 192 extend between a central opening 194 located about the drive shaft 172 and the annular cavity 190. Annular cavity 190 is in fluid communication with a plurality of axial fluid passages 195 which extend through the central portion 184 of the housing 180 of the electric motor/generator 102. The second end cap 186 of the electric motor/generator 102 includes a fluid inlet port 196 (FIG. 3) and a plurality of radially extending fluid passages (not shown in FIG. 4) that establish fluid communication between the inlet port 196 and the axial passages 195. A sensor port 197 is also arranged in the end cap 186. The sensor port 197, if desired, may be used for providing feedback information concerning the motor/generator 102 in a well known manner, such as feedback information concerning the rotational position of the rotating electrical power conversion mechanism 173 to optimize control of the motor/generator 102. Electrical wires 198 provide suitable electrical connections to supply electrical energy from the motor/generator 102 when it is operated as a generator and to supply electrical energy to the motor generator 102 when it is operated as a motor, in a well known manner.

Figure 5:
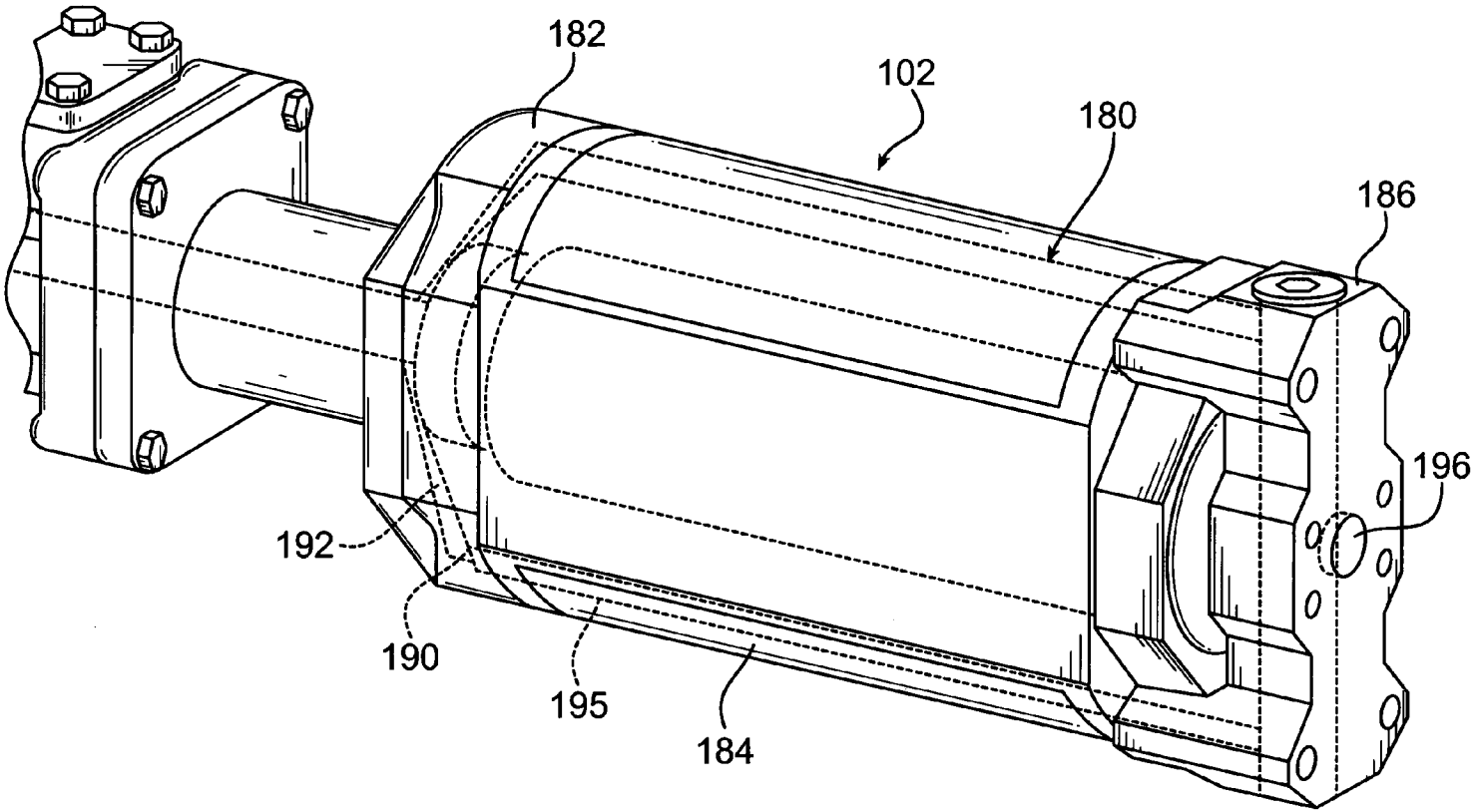
FIG. 5 is a view similar to FIG. 3, but showing only a portion of the embodiment of FIG. 3 and showing certain internal passages of such portion in dotted schematic outline to show the flow path of fluid through such portion.

The clutch 120 of the power take off device 108 is normally disengaged and is electrically operated and controlled by a clutch control electrical switch (not shown) in the cab of the truck and in the man lift bucket in the preferred embodiment illustrated in FIGS. 3-5. Each control switch may have three positions to provide a first, second and third mode of operation for the integrated fluid handling apparatus 100. The first position for each electrical switch provides the first mode of operation, in which the clutch 120 is engaged to drivingly connect the input device 129 and the rotating power take off mechanism 122 to an output shaft 128 of the power take off device 46. The second position of each electrical switch provides the second mode of operation, in which the clutch 120 is disengaged to mechanically isolate the rotating power take off mechanism 122 from the rotating fluid power pump mechanism 146 and from the rotating electrical power conversion mechanism 173, while the driving connection between the rotating mechanisms 146 and 173 is maintained. The third position of each electrical switch provides the third mode of operation, in which the clutch 120 is disengaged and the integrated fluid handling apparatus is fully shut down such as for over the highway operation of the vehicle upon which the apparatus 100 is used.

In the first mode of operation, with the clutch 120 of the power take-off device 108 engaged, the input gear 129 is coupled to the rotating power take off mechanism 122 and to the output shaft 128 of the power take-off device 108 to drive both the hydraulic pump 104 and the electric motor/generator 102, via the output shaft's connection with shafts or drive connector devices 138, 166 and 172. When the hydraulic pump 104 is driven, the pump 104 draws the fluid from an external source such as a hydraulic reservoir into the electric motor/generator 102 and through the passages 195 in the central portion 184 of the housing 180 for cooling the electric motor/generator. The hydraulic fluid then passes through the flow torque tube 106 and enters the hydraulic pump 104. After being acted on by the rotating fluid pump mechanism 146 of the hydraulic pump 104, the fluid exits through the higher pressure outlet port 142 and flows toward the fluid system. The fluid system is not shown in the drawings, but the fluid system may be any mobile or stationary fluid system such as for transfer of fluids or for providing fluid power. In the preferred embodiment, as mentioned above, the fluid system that is powered by the integrated fluid handling apparatus is a hydraulic system for causing and controlling the motion of a man lift bucket mounted on an over the highway truck. When the electric motor/generator 108 is driven during this first mode of operation, the electric motor/generator operates as a generator and supplies electrical energy through wires 198 to a suitable electrical storage device, such as supplying such energy through an inverter (not shown) to electrical batteries (not shown)

In the second mode of operation, with the clutch 120 of the power take-off device 108 disengaged, the electric motor/generator 102 is provide with electrical energy from the above mentioned electrical power storage device and operates as an electric motor for driving the hydraulic pump 104 via shaft 172, shaft 166 and shaft 138. When operating as an electric motor, the electric motor/generator 102 continues to be cooled by hydraulic fluid in the manner described above. During this second mode of operation, if the electrical power storage device becomes depleted of stored electrical energy, the fossil fuel engine of the vehicle may be automatically started and the clutch 120 may be automatically engaged, so that the pump 102 continues to be driven to supply fluid to the above described fluid power system.

In the third mode of operation, the integrated fluid handling apparatus 100 in the preferred embodiment shown in FIGS. 3 and 4 is partially or fully shut down. In this mode of operation, the man lift bucket is lowered and stored and locked in its over the road travel position. The clutch 120 is disengaged. This prevents any operation of the integrated fluid handling apparatus 100 to move the man lift bucket or other fluid operated device during travel or storage of the vehicle upon which the apparatus 100 is mounted or during any other conditions in which operation of the device that is powered by the integrated fluid handling apparatus 100 is to be discontinued. In a modification of the preferred embodiment, the third mode of operation or another mode of operation may be used to operate the electric motor/generator 102 as a generator. In this modification, the electric motor/generator 102 may be used as a generator to charge the energy storage device using power from the engine or brake energy recovery during braking. In this modification, the hydraulic pump may only be used for cooling.

The apparatus 100 of the present invention utilizes the hydraulic fluid to be supplied to the lower pressure pump inlet 140 and pumped by the hydraulic pump 104 for cooling the electric motor/generator 102. Fluid from an external source such as a reservoir is provided into passage 196 (FIG. 3) in the second end cap 186 of the electric motor/generator 102. The hydraulic fluid passes through the second end cap 186 and enters the central portion 184 of the housing of the electric motor/generator 102. After passing though the central housing portion 184 of the electric motor/generator 102, hydraulic fluid enters the first end cap 182 and flows from the annular chamber 190 through the radial passages 192 into the central cavity 194. Hydraulic fluid then flows through the annular passage 164 of the flow tube 106 and enters the hydraulic pump 104 through inlet port opening 140. After entering the hydraulic pump 104 through opening 140, hydraulic fluid located in chamber 158 is directed into the rotating fluid power pump mechanism 146 in a known manner through appropriate porting. After being acting on by the rotating fluid pump mechanism 146 of the hydraulic pump 104, hydraulic fluid is output through port 142 and is directed toward the hydraulic system for use. Alternatively or additionally, the fluid could flow through the inside of the electric motor/generator housing 136 in which the rotor is located before passing through the pump inlet 140, and in this case the rotating electrical power conversion mechanism 173 is surrounded by fluid for cooling.

FIG. 5 schematically illustrates the flow of hydraulic fluid through the electric motor/generator 102 by dotted lines. As illustrated in FIG. 5, hydraulic fluid enters the second end cap 186 through port 196 at which time it is directed radially into an annular cavity. After the end cap 186, the hydraulic fluid enters the passages 195 in jacket portion 184 of the housing 180 of the electric motor/generator 102 for cooling the electric/motor generator. After passing from the jacket portion 184, hydraulic fluid enters the second end cap 182, flows radially inwardly through the passages 192, and exits the electric motor/generator through opening 194. The hydraulic fluid then is directed into the hydraulic pump 104 via the annular passage 164 of the flow tube 106.

The power take off device 108 and the hydraulic pump 104 and the flow torque tube 106 and the electric motor generator 102 in the preferred embodiment may each be initially assembled separately as a subassembly operation for convenience of manufacturing and may then be integrated into the integrated fluid handling apparatus 100. The housing 124 of the power take off device 108 and the housing 136 of the hydraulic pump 104 and the housing 159 of the flow torque tube 106 and the housing 180 of the electric motor/generator 102 are all mechanically and hydraulically secured together by stationary sealing surfaces and stationary seals and threaded fasteners to provide a single unitary housing 199. The drive shaft 128 and the drive shaft 138 and the drive shaft 166 and the drive shaft 172 and the clutch 120 provide a unitary rotational power transfer system for the apparatus 100, which is drivingly connected to and drivingly connects the rotating fluid pump mechanism 146 and the rotating power take off device mechanism 122 and the rotating electrical power conversion mechanism 173 under a first mode of operation explained more fully below when the clutch 120 is engaged. This unitary rotational power transfer system and the rotating mechanisms 122 and 146 and 173 are located within and are integrated within the housing 199. This unitary rotational power transfer system also is drivingly connected to and drivingly connects the rotating fluid pump mechanism 146 and the rotating electrical power conversion mechanism 173, and drivingly disengages both of the mechanisms 146 and 173 from the rotating power take off device mechanism 122 under other modes of operation explained more fully above when the clutch 120 is disengaged.

By using hydraulic fluid used in the hydraulic system for cooling the electric motor/generator 102 before such fluid is acted upon by the rotating fluid pump mechanism 146, the fluid that is providing the cooling function is at a lower temperature and provides a greater temperature gradient between the fluid and the surfaces from which heat is to be transferred to the fluid, to provide maximum heat removal. Additionally, the apparatus 100 of the present invention significantly reduces the size of the electric motor/generator 102 relative to comparable air cooled or fan cooled electric motor/generators. This reduced size is of significant advantage for being located in mobile equipment such as vehicles. Additionally, hydraulic fluid leakage and physical size and energy loss are all minimized by the preferred embodiment shown in FIGS. 3 and 4 by integrating within the unitary housing 198 the rotating power take off device mechanism 122 and the rotating fluid power pump mechanism 146 and the rotating electrical power conversion mechanism 173, all rotating mechanical connector devices 48 and 128 and 138 of the mechanical power transfer system that drivingly connects the rotating mechanisms 122 and 146 and 173, and all fluid connections between those rotating mechanisms.

Figure 6:
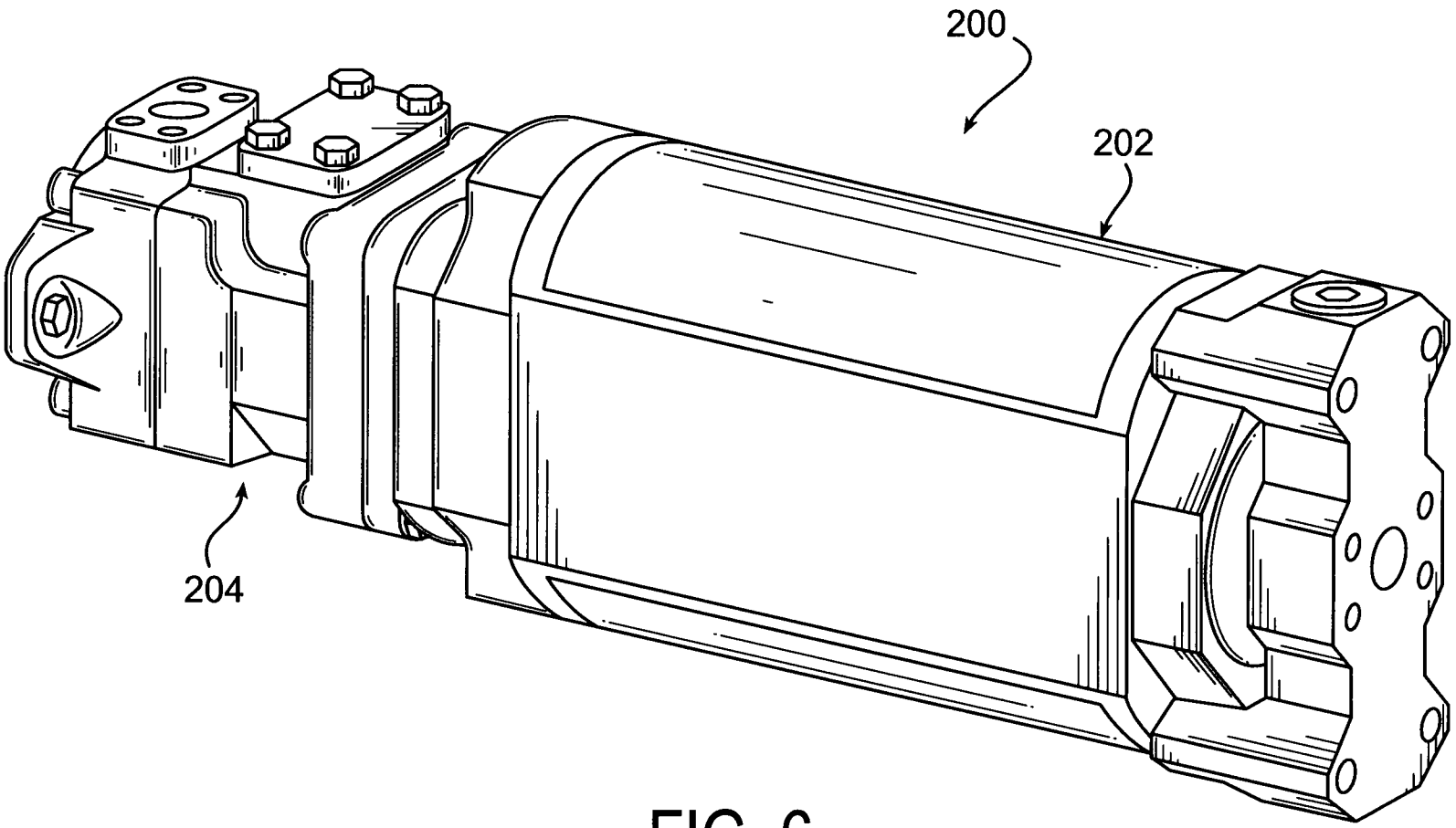
FIG. 6 is a perspective view of another embodiment of the present invention.

FIG. 6 illustrates a perspective view of an apparatus 200 in which the electric motor/generator 202 is connected to the hydraulic pump 204 directly instead of through a flow tube. When the flow tube is illuminated, hydraulic fluid flows from central passage (similar to passage 194) directly into the hydraulic pump 204. Although the embodiments of FIGS. 3, 4 and 5 illustrates the flow tube, the primary purpose of the flow tube is to space the electric motor/generator 102 away from the hydraulic pump to enable packaging adjacent to a vehicle transmission. This spacing prevents interference between the electric motor/generator 102, for example, and the transmission upon which the power take-off device 108 may be mounted.

Figure 7:
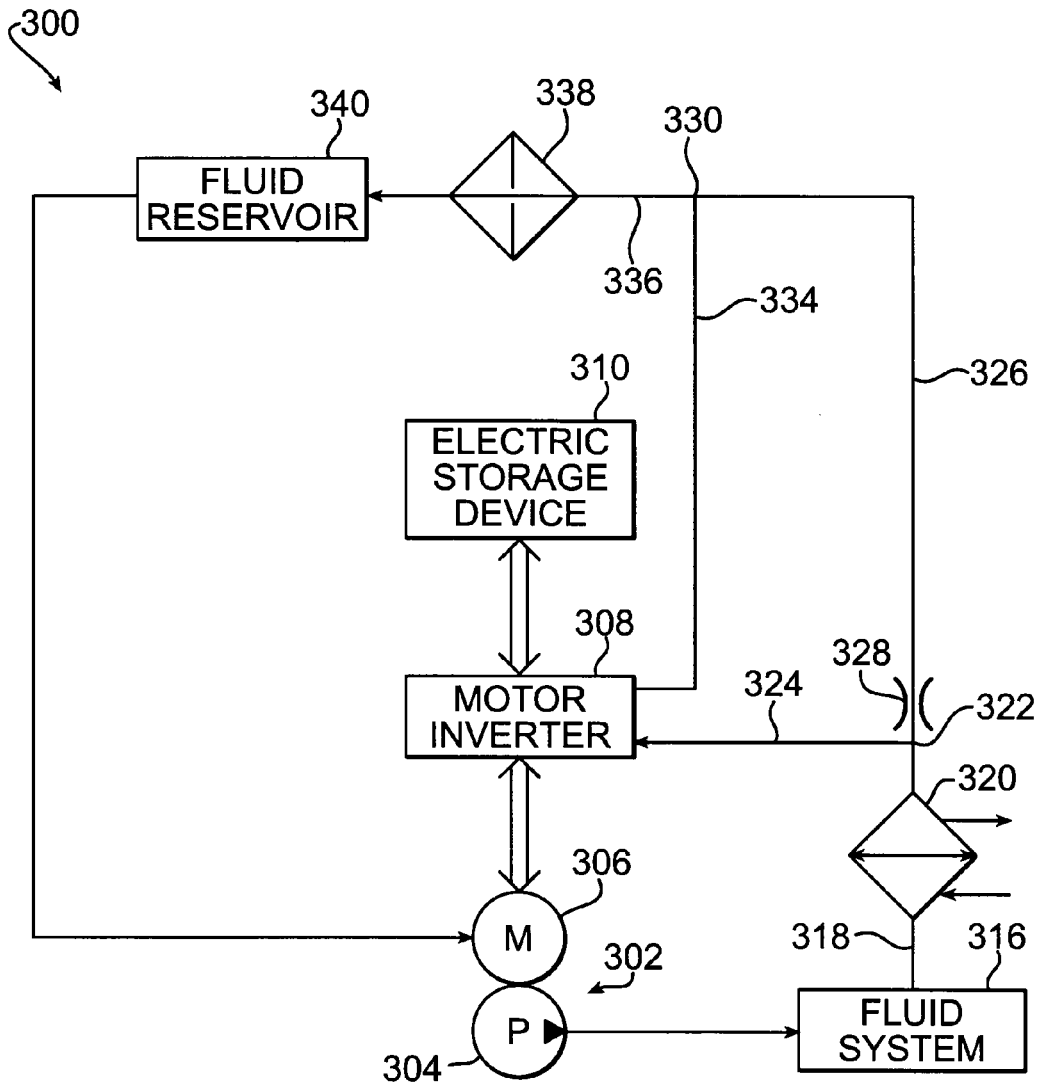
FIG. 7 is a schematic circuit diagram of another embodiment of the present invention.

FIG. 7 illustrates a system 300 which utilizes an apparatus similar to that illustrated as apparatus 100 in FIGS. 3 and 4 and apparatus 200 in FIG. 6. The apparatus in FIG. 7 is referred to generically as reference numeral 302. Illustrated apparatus 302 includes a hydraulic pump 304 and an electric motor/generator 306 that are coupled together mechanically and are also in fluid communication with one another, as previously described. The electric motor/generator 306 is illustrated in FIG. 7 as being connected electrically to a motor inverter 308, which is connected to an electric storage device 310. FIG. 7 also illustrates the pump 304 being hydraulically connected to a hydraulic system 316. A return conduit 318 from the hydraulic system 316 is illustrated as optionally passing through heat exchanger 320 and then is directed to a union 322 at which the conduit 318 is divided into a first conduit 324 and a second conduit 326. The first conduit 3243 is directed into the motor inverter 308 for cooling of the motor inverter. The second conduit 326 includes an orifice 328 for creating a pressure drop for forcing fluid toward the motor inverter 308. Other means for creating a pressure drop for directing hydraulic fluid to the motor inverter 308 may be used such as, for example, a temperature control device which only directs the hydraulic fluid to the motor inverter 308 when the exchange of heat is necessary. Downstream of the motor inverter 308, a second union 330 is provided in which a conduit exiting the motor inverter 308 and conduit 326 are again combined into a single conduit 336. Conduit 336 passes hydraulic fluid through a filter 338 and to a hydraulic reservoir 340. In the system 300 illustrated in FIG. 7, the hydraulic fluid that cools the electric motor/generator 306 and is provided to the hydraulic system by the hydraulic pump 304 later acts to cool the motor inverter 308. Within the motor inverter 308 is a heat exchanger which utilizes the hydraulic fluid for cooling the motor inverter.

An advantage of using the hydraulic fluid for cooling the motor inverter 308 is that no separate cooling pump is needed for cooling the motor inverter. Additionally, the amount of cooling flow directed through the electric motor/generator 306 and the motor inverter 308 increases with increased system demand. Therefore, the more the hydraulic system 316 demands fluid from the hydraulic pump 304, the more hydraulic fluid is directed through the electric motor/generator 306 and the motor inverter 308.

From the above description of the invention, those skilled in the art will perceive improvements, changes and modifications. For example, although a jacketed electric motor/generator is described above, the electric motor/generator may be flooded. Such improvements, changes and modifications within the skill of the art are intended to be covered by the appended claims.

Presently preferred embodiments of the invention are shown in the drawings and described in detail above. The invention is not, however, limited to these specific embodiments. Various changes and modifications can be made to this invention without departing from its teachings, and the scope of this invention is defined by the claims set out below.

What is claimed is:

1. An integrated fluid handling apparatus comprising:

a fluid pump having a fluid pump mechanism, said fluid pump mechanism having a lower pressure fluid inlet for supplying lower pressure fluid to said fluid pump mechanism and a higher pressure fluid outlet for supplying higher pressure fluid after said fluid has been acted upon by said fluid pump mechanism;

a power take off device for being driven by a power source and having a power take off device mechanism;

an electric motor having an electrical power conversion mechanism;

a power transfer system including connector devices drivingly connected to and drivingly connecting said fluid pump mechanism and said power take off device mechanism and said electrical power conversion mechanism in one mode of operation;

said electric motor further including at least one heat exchange fluid flow passage, and said fluid flow passage being connected to and establishing a fluid flow path to said lower pressure fluid inlet of said fluid pump.

2. An integrated fluid handling apparatus as set forth in claim 1, including a unitary housing, said fluid pump mechanism and said power take off device mechanism and said electrical power conversion mechanism and said power transfer system all being disposed within said unitary housing.

3. An integrated fluid handling apparatus as set forth in claim 2, wherein said at least one fluid flow passage provides the sole fluid input to said lower pressure fluid inlet.

4. An integrated fluid handling apparatus as set forth in claim 2, wherein said power transfer system is operable between said one mode of operation and another mode of operation, said power transfer system connector devices further being drivingly connected to and drivingly connecting said rotating fluid pump mechanism and said rotating electrical power conversion mechanism when said rotational power transfer system is in said another mode of operation, said power transfer system connector devices drivingly isolating said rotating power take off device mechanism from said rotating fluid pump mechanism and from said electrical power conversion mechanism when said power transfer system is in said another mode of operation.

5. An integrated fluid handling apparatus as set forth in any of preceding claims 1-4, wherein each of said mechanisms is a rotating mechanism, said rotating fluid pump mechanism has a longitudinal axis and opposite lateral sides, said rotating electrical power conversion mechanism is disposed on one of said lateral sides, and said rotating power take off device mechanism is disposed on the other of said lateral sides.

6. An integrated fluid handling apparatus comprising:

a fluid pump having a pump housing, a rotating fluid pump mechanism within said pump housing, said rotating fluid pump mechanism having a lower pressure fluid inlet for supplying lower pressure fluid to said rotating fluid pump mechanism and a higher pressure fluid outlet for supplying higher pressure fluid after said fluid has been acted upon by said rotating fluid pump mechanism;

a power take off device for being driven by a power source and having a power take off device housing, a rotating power take off device input mechanism;

an electric motor generator having a housing, a rotating electrical power conversion mechanism within said housing;

a rotational power transfer system operable between a first mode of operation and a second mode of operation, said rotational power transfer system including connector devices drivingly connected to and drivingly connecting said rotating fluid pump mechanism and said rotating power take off device input mechanism and said rotating electrical power conversion mechanism when said power transfer system is in said first mode of operation, said rotational power transfer system connector devices further being drivingly connected to and drivingly connecting together said rotating fluid pump mechanism and said rotating electrical power conversion mechanism when said rotational power transfer system is in said second mode of operation, said rotational power transfer system connector devices drivingly isolating said rotating power take off device input mechanism from said rotating fluid pump mechanism and from said rotating electrical power conversion mechanism when said rotational power transfer system is in said second mode of operation;

at least one fluid flow passage disposed in heat exchange relationship to said electric motor generator, and said fluid flow passage being connected to and establishing a fluid flow path to said lower pressure fluid inlet of said fluid pump.

7. An integrated fluid handling apparatus as set forth claim 6, further including stationary connector devices connected to said pump housing and said power take off device housing and said electric motor generator housing to secure all of said housings together into a single unit.

8. An integrated fluid handling apparatus as set forth in claim 6, wherein said fluid pump housing has a longitudinal axis and opposite lateral sides, said electric motor housing is disposed on one of said lateral sides, and said power take off device housing is disposed on the other of said lateral sides.

9. An integrated fluid handling apparatus as set forth in claim 6, wherein said fluid flow passage provides the sole fluid input to said lower pressure fluid inlet.

10. An integrated fluid handling apparatus as set forth in claim 6, wherein said connector devices include a shaft connected to and rotating with said rotating fluid pump mechanism and said rotating electrical power conversion mechanism, a clutch having engaged and disengaged positions and having a rotating clutch component connected to and rotating with said rotating power take off device input mechanism, said clutch is in said engaged position in said first mode of operation, and said clutch is in said disengaged position in said second mode of operation.

11. An integrated fluid handling apparatus as set forth in claim 10, wherein said power take off device further includes a rotating power take off device output mechanism, said connector devices being drivingly connected to said rotating power take off device output mechanism and said rotating fluid pump mechanism and said rotating electrical power conversion mechanism in said first and second modes of operation, and said clutch includes another rotating clutch component connected to and rotating with said rotating power take off device output mechanism.

12. An integrated fluid handling apparatus as set forth in claim 11, wherein said rotating fluid pump mechanism and said rotating power take off device output mechanism and said rotating electrical power conversion mechanism are coaxial with one another.

13. An integrated fluid handling apparatus as set forth in any of claims 1-3 or 6-12, wherein said rotating fluid pump mechanism and said rotating electrical power conversion mechanism are separated from one another by a flow torque tube, said flow torque tube includes another fluid passage connecting said fluid flow passage and lower pressure fluid inlet, and said flow torque tube includes said connector device that drivingly connects said rotating fluid pump mechanism and said rotating electrical power conversion mechanism in said first and second modes of operation.

14. An integrated fluid handling apparatus as set forth in any of claim 1-3 or 6-12, wherein said connector devices include a shaft connected to and rotating with said rotating fluid pump mechanism and said rotating electrical power conversion mechanism, and said shaft passes through said lower pressure fluid inlet.

15. An integrated fluid handling apparatus as set forth in claim 6, further including an electrical power inverter, inverter fluid flow passages arranged in heat exchange relationship with said inverter, said inverter fluid flow passages being connected to and establishing a fluid flow path with said higher fluid pressure fluid outlet.

16. An integrated fluid handling apparatus as set forth in claim 15, including a device restricting fluid flow from said higher fluid pressure fluid outlet to said inverter fluid flow passages.

17. An integrated fluid handling apparatus comprising:

a hydraulic pump housing;

a rotating fluid pump mechanism within said pump housing, said rotating fluid pump mechanism having a lower pressure fluid inlet for supplying lower pressure hydraulic fluid to said rotating fluid pump mechanism and a higher pressure fluid outlet for supplying higher pressure hydraulic fluid after said hydraulic fluid has been acted upon by said rotating fluid pump mechanism, said rotating fluid pump mechanism further having a first lateral side and a second lateral side and a central axis extending longitudinally through said rotating fluid pump mechanism and extending in opposite directions away from said sides;

said rotating fluid pump mechanism further including a first rotating fluid pump mechanism connector device operably connected for movement with said rotating fluid pump mechanism on one of said sides of said rotating fluid pump mechanism, a second rotating fluid pump mechanism connector device operably connected for movement with said rotating fluid pump mechanism on the other of said sides of said rotating fluid pump mechanism;

a power take off device for being driven by a fossil fuel engine and having a power take off device housing, a first power take off device connector device arranged to be driven by said engine, a second power take off device connector device, a clutch operably arranged between said first and second power take off device connector devices to operably connect said first and second power take off device connector devices in a first mode of operation when said clutch is engaged and to operably disconnect said first and second power take off device connector devices in a second mode of operation when said clutch is disengaged, said second power take off device connector device being drivingly connected to said first rotating fluid pump mechanism connector device;

an electric motor generator having a housing, a rotating electrical power conversion mechanism within said housing for using or generating electrical power, a rotating electrical power conversion mechanism connector device drivingly connected to said rotating electrical power conversion mechanism, said rotating electrical power conversion mechanism connector device being drivingly connected to said second rotating fluid pump mechanism connector device;

said first power take off device connector device being drivingly connected to and driving rotational movement of said rotating fluid pump mechanism through said clutch and through said second power take off device connector device to generate fluid power, and said first power take off device connector device being drivingly connected to and driving rotational movement of said rotating electrical power conversion mechanism through said clutch and through said second power take off device connector device to generate electrical power, all in a first mode of operation when said power take off device clutch is engaged;

said rotating electrical power conversion mechanism being drivingly connected to and driving rotational movement of said rotating fluid pump mechanism through said rotating electrical power conversion mechanism connector device and through said second rotating fluid pump mechanism connector device, and said rotating fluid pump mechanism being drivingly disconnected from said first power take off device connector device, all in a second mode of operation when said clutch is disengaged;

fluid flow passages extending longitudinally relative to said electric motor generator housing and arranged to transfer heat from said electric motor generator; and said fluid flow passages establishing a fluid flow path to said lower pressure fluid inlet of said hydraulic pump.

18. An integrated fluid handling apparatus as set forth claim 17, wherein said hydraulic pump housing and said power take off device housing and said electric motor generator housing are integral.

19. An integrated fluid handling apparatus as set forth in claim 18 wherein said rotating fluid pump mechanism and said rotating electrical power conversion mechanism are coaxial with one another.

20. An integrated fluid handling apparatus as set forth in any of claims 17-19, wherein said rotating fluid pump mechanism and said rotating electrical power conversion mechanism are separated from one another by a flow torque tube, said flow torque tube includes another fluid passage connecting said first mentioned fluid flow passages and lower pressure fluid inlet, and said flow torque tube drivingly connects said rotating fluid pump mechanism and said rotating electrical power conversion mechanism in said first and second modes of operation.

21. An integrated fluid handling apparatus as set forth in claim 17, wherein said rotating fluid pump mechanism and said rotating electrical power conversion mechanism are separated from one another by a flow torque tube, said flow torque tube includes another fluid passage connecting said fluid flow passages and lower pressure fluid inlet, said flow torque tube includes at least one of said connector devices that drivingly connect said rotating fluid pump mechanism and said rotating electrical power conversion mechanism in said first and second modes of operation, said flow torque tube including a shaft connected to and rotating with said rotating fluid pump mechanism and said rotating electrical power conversion mechanism, and said shaft passes through said lower pressure fluid inlet.

22. An integrated fluid handling apparatus as set forth in claim 21, further including an electrical power inverter, inverter fluid flow passages arranged in heat exchange relationship with said inverter, said inverter fluid flow passages being connected to and establishing a fluid flow path with said higher fluid pressure fluid outlet, and a fluid orifice restricting fluid flow from said higher fluid pressure fluid outlet to said inverter fluid flow passages.

23. An apparatus comprising a hydraulic fluid power pump having pumping components for pumping hydraulic fluid and including an inlet for providing hydraulic fluid to the pumping components;

an electric machine for converting energy, at least one fluid flow passage associated with the electric machine and through which hydraulic fluid flows for removing heat from the electric machine;

a power take-off device having an output shaft;

the hydraulic pump and the electric machine being integrated into and disposed within a unitary housing in which hydraulic fluid passing through the at least one flow passage is hydraulically connected to the inlet of the hydraulic pump.

24. The apparatus of claim 23 wherein the electric machine includes rotating components that convert energy between mechanical energy and electrical energy.

25. The apparatus of claim 24 wherein the hydraulic pump pumping components and the electric machine rotating components are coaxially disposed within said housing.

26. The apparatus of claim 24 wherein said electric machine rotating components include a first shaft, said hydraulic pump includes a second shaft; and said first and second shafts are coupled together and are fixed for rotation with one another.

27. The apparatus of claim 23, wherein the electric machine and the hydraulic pump are separated from one another by a flow torque tube, said flow torque tube including a coupling and a flow tube passage, said coupling being operably connected to said first and second shafts for transmitting power between said shafts, and hydraulic fluid exiting the at least one flow passage passing through the flow tube passage prior to entering the inlet of the hydraulic pump.

28. The apparatus of claim 26, wherein said second shaft passes through said inlet to said hydraulic pump.

29. The apparatus of claim 23, wherein said electric machine includes an electric motor, said apparatus further includes an electrical current inverter, and hydraulic fluid downstream of said hydraulic pump being directed through said inverter for removing heat from said inverter.

30. An apparatus comprising a hydraulic pump having pumping components for pumping hydraulic fluid and including an inlet for providing hydraulic fluid to the pumping components;

an electric machine for converting energy between mechanical and electrical states, at least one flow passage associated with the electric machine and through which hydraulic fluid flows for removing heat from the electric machine, the electric machine including a first shaft and the hydraulic pump including a second shaft and, and the first and second shafts are coupled together and are fixed for rotation with one another; and a power take-off device having an output shaft, the output shaft of the power take-off device being coupled to at least one of the first and second shafts and being fixed for rotation with the first and second shafts, the hydraulic pump and the electric machine being integrated into a single package in which hydraulic fluid passing through the at least one flow passage is directed to the inlet of the hydraulic pump.

31. The apparatus of claim 30, wherein the first and second shafts and the output shaft are coaxial with one another.

32. The apparatus of claim 30, wherein the electric machine and the hydraulic pump are separated from one another by a flow tube, the flow tube including a coupling for coupling together the first and second shafts, hydraulic fluid exiting the at least one flow passage passing through the flow tube prior to entering the inlet of the hydraulic pump.

33. The apparatus of claim 32, wherein the second shaft passes through the inlet to the hydraulic pump.

34. The apparatus of claim 30, wherein the second shaft passes through the inlet to the hydraulic pump.

35. The apparatus of claim 30, further including an inverter associated with the electric machine, hydraulic fluid downstream of the hydraulic pump being directed through the inverter for removing heat from the inverter.

* * * * *